US006799007B2

(12) United States Patent
Suketomo

(10) Patent No.: US 6,799,007 B2
(45) Date of Patent: Sep. 28, 2004

(54) GUIDE ROLLER UNIT INCLUDING CLEANING BLADE FOR GUIDE ROLLER

(75) Inventor: Seiji Suketomo, Hyogo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/286,851

(22) Filed: Nov. 4, 2002

(65) Prior Publication Data

US 2003/0215258 A1 Nov. 20, 2003

(30) Foreign Application Priority Data

May 16, 2002 (JP) ..... 2002-141510

(51) Int. Cl.[7] ..... G03G 21/00
(52) U.S. Cl. ..... 399/99
(58) Field of Search ..... 271/109, 119; 399/98, 99, 381, 393, 411, 107

(56) References Cited

U.S. PATENT DOCUMENTS 6,055,407 A * 4/2000 Inoue et al. ..... 399/381

* cited by examiner

*Primary Examiner*—Hoang Ngo
(74) *Attorney, Agent, or Firm*—Westerman, Hattori, Daniels & Adrian, LLP

(57) ABSTRACT

A guide roller unit, provided for use in an electrophotographic printer, includes a guide roller and a cleaning blade. For guiding printing paper, the guide roller is provided with a contact surface that comes into contact with a surface of the printing paper on which an unfixed toner image is produced. The cleaning blade comes into contact with the contact surface of the guide roller for removing toner on the roller. The contact surface of the guide roller is provided with a blade contact portion, such as a projection or groove, for causing the cleaning blade to vibrate.

13 Claims, 4 Drawing Sheets

GUIDE ROLLER UNIT INCLUDING CLEANING BLADE FOR GUIDE ROLLER

BACKGROUND OF THE INVENTION

1. Field of the Invention

The present invention relates to a guide roller unit coming into contact with printing paper. The present invention also relates to a printer incorporating such a guide roller unit.

2. Description of the Related Art

In an electrophotographic printer, long continuous printing paper is often used for making a hard copy of the output information. Without any particular needs, only one side of the printing paper is used for printing. To economize the printing paper or achieve high-speed printing operation, however, it is desirable that the both sides of the printing paper are used for printing.

In a printer designed to perform such double-side printing, the operation may generally proceed as follows. First, a toner image is produced on one side (first side) of the printing paper by a first printing unit. Then, a fixing unit fuses the toner image onto the paper for permanent fixation. The printing paper is then fed to a second printing unit located downstream from the first printing unit along the paper transfer path. There, another toner image is produced on the other side (second side) of the printing paper, and fused for permanent fixation. According to this process, the printing paper may be thermally damaged (shriveled, for example) when the toner image on the first side of the paper is fused. Unfavorably, the second printing unit may fail to produce a proper toner image on such deformed printing paper.

This problem can be addressed by the following procedure. To begin with, a first transfer unit causes a toner image produced on a first photosensitive drum to be transferred onto a first side of the printing paper. Then, a second transfer unit, disposed downstream from the first transfer unit, causes a toner image produced on a second photosensitive drum to be transferred onto a second side (the opposite side) of the printing paper. Finally, two fixing units, disposed further downstream along the paper transfer path, fuse the unfixed transferred toner images onto the first and second sides of the printing paper, respectively. According to this printing procedure, the fixing of the toner images is performed after the transferring of the toner images from the photosensitive drums to the printing paper. Thus, it is possible to prevent the deterioration of printing quality which would otherwise result from the thermally deformed printing paper.

While enjoying such an advantage, the above printing method suffers the following drawback.

For implementing the printing, one or two guide roller units need to be provided for maintaining a prescribed distance between the printing paper and the first or second photosensitive drum. The guide roller unit is provided with a guide roller coming into contact with the printing paper. While contacting with the printing paper, the guide roller is caused to roll over the unfused toner image transferred onto the paper, whereby some toner is adhered to the contact surface of the guide roller.

In order to keep the guide roller clean, the guide roller unit is provided with a cleaning blade held in contact with the contact surface of the guide roller for scraping off the adhered toner from the rotating roller. In this arrangement, however, paper dust or any other dust tends to get stuck between the cleaning blade and the contact surface of the guide roller, preventing the cleaning blade from coming into full contact with the guide roller. In this situation, the adhering toner on the guide roller cannot be scraped off completely, which deteriorates the printing quality.

SUMMARY OF THE INVENTION

The present invention has been proposed under the circumstances described above. It is, therefore, an object of the present invention to provide a guide roller unit whereby a collection of paper dust (or any other dust) can be automatically shaken off the cleaning blade.

According to a first aspect of the present invention, there is provided a guide roller unit including: a guide roller for guiding printing paper, the guide roller being provided with a contact surface that comes into contact with a toner image forming surface of the printing paper; and a cleaning blade that comes into contact with the contact surface of the guide roller for removing toner adhered to the contact surface. The contact surface of the guide roller is provided with a blade contact portion for vibrating the cleaning blade so that a collection of dust can be shaken off the blade.

Preferably, the blade contact portion may be a projection or a groove. The projection may be about 20 $\mu$m in height, while the groove may be about 20 $\mu$m in depth.

Preferably, the guide roller may be composed of a core made of a stainless metal and a fluoroplastic layer surrounding the core.

Preferably, the blade contact portion, such as a projection and a groove, extends over the entire width of the contact surface of the guide roller.

According to a second aspect of the present invention, there is provided a printer including: a photosensitive member upon which a toner image is produced; a transfer unit for transferring the toner image onto a first surface of the printing paper; a fixing unit for fixing the transferred toner image on the first surface of the printing paper, the fixing unit being located downstream from the transfer unit along a paper transfer path for the printing paper; and a guide roller unit that includes a guide roller coming into contact with the first surface of the printing paper, the guide roller unit also including a cleaning blade coming into contact with the guide roller for removing toner adhering to the guide roller. The guide roller unit may be located between the transfer unit and the fixing unit. The guide roller is provided with at least one of a projection and a groove that extend along the rotational axis of the guide roller for vibrating the cleaning blade by contacting therewith.

Preferably, the printer of the present invention may further include a detecting unit for checking whether or not the guide roller is unacceptably worn thin.

Preferably, the detecting unit may monitor the variation in driving current supplied to a motor to actuate the guide roller.

Preferably, the printer of the present invention may further include: an additional photosensitive-member; an additional transfer unit for causing a toner image produced on the additional photosensitive member to be transferred onto a second surface of the printing paper opposite to the first surface of the printing paper; a first fixing unit for fixing the toner image transferred onto the first surface, the first fixing unit being located downstream from the additional transfer unit along the paper transfer path; and a second fixing unit for fixing the toner image transferred onto the second surface, the second fixing unit being located downstream from the additional transfer unit along the paper transfer path.

Preferably, the printer of the present invention may further include an additional guide roller unit located between the additional transfer unit and the second fixing unit. The additional guide roller unit may include a second-surface guide roller coming into contact with the second surface of the printing paper and also include a cleaning blade coming into contact with the second-surface guide roller for removing toner adhering to the second-surface guide roller. The second-surface guide roller is provided with one of a projection and a groove that come into contact with the cleaning blade.

Other features and advantages of the present invention will become apparent from the detailed description given below with reference to the accompanying drawings.

DETAILED DESCRIPTION OF THE PREFERRED EMBODIMENT

Preferred embodiments of the present invention will be described below with reference to the accompanying drawings.

Figure 1:
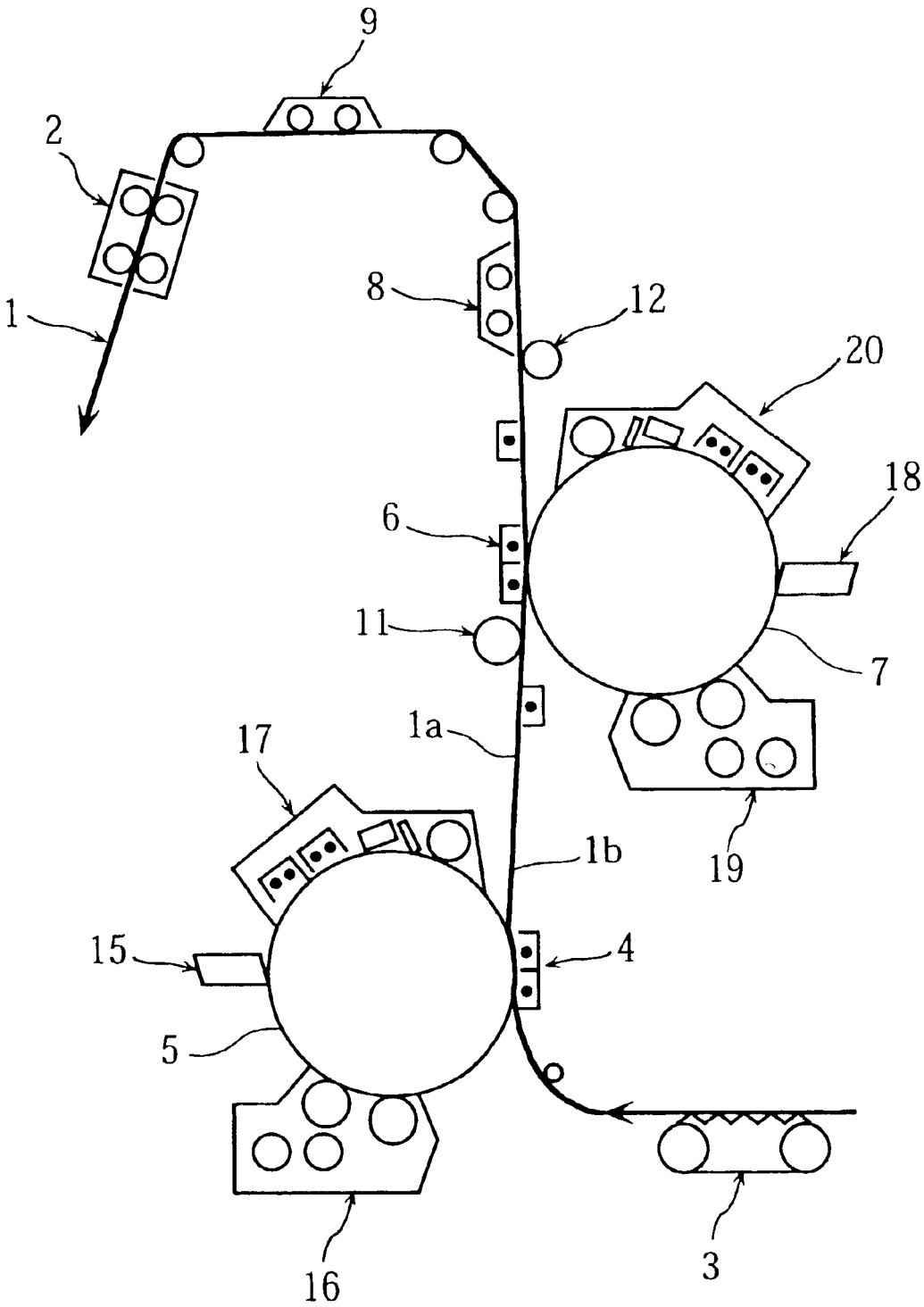
FIG. 1 shows the principal components of a printer provided in accordance with the present invention.

FIG. 1 shows the principal components of an electrophotographic printer embodying the present invention. In the illustrated printer, as will be described in detail below, the both sides of long, continuous recording paper 1 are subjected to printing operation.

The continuous recording paper 1 is initially stored in a paper stocker (not shown) of the printer. In operation, the paper 1 is drawn out from the stocker and advanced along a predetermined paper transfer path by a pinch roller unit 2 in a direction indicated by arrows. The transfer speed of the paper 1 is controlled by a tractor 3. The recording paper 1 has a first print side 1*a* and a second print side 1*b* opposite to the first print side 1*a*. A first transfer unit 4 causes a toner image formed on a first photosensitive drum 5 to be transferred onto the first print side 1*a* of the paper 1, whereas a second transfer unit 6 causes a toner image formed on a second photosensitive drum 7 to be transferred onto the second print side 1*b* of the paper 1. The second transfer unit 6 is disposed downstream from the first transfer unit 4 along the paper transfer path. The photosensitive drums 5, 7 may be replaced by photosensitive belts.

The toner image transferred onto the first print side 1*a* of the paper 1 is fixed by a first flash-fusing unit 8, while the toner image transferred onto the second print side 1*b* of the paper 1 is fixed by a second flash-fusing unit 9. The first flash-fusing unit 8 is disposed downstream from the second transfer unit 6 but upstream from the second flash-fusing unit 9 along the paper transfer path.

Between the first and the second transfer units 4 and 6 is disposed a first guide roller unit 11 arranged to come into contact with the first recoding side 1*a* of the paper 1 for maintaining the prescribed distance between the paper 1 and the second photosensitive drum 7. Likewise, a second guide roller unit 12 is provided between the second transfer unit 6 and the first flash-fusing unit 8 for maintaining the prescribed distance between the paper 1 and the first flash-fusing unit 8 by contacting with the second recording side 1*b* of the paper 1.

As shown in FIG. 1, the first photosensitive drum 5 is surrounded by an optical unit 15 serving to produce an electrostatic latent image on the cylindrical surface of the drum 5, a developing unit 16 serving to make the latent image visible by applying toner, and a cleaning/charging unit 17 serving to remove unwanted toner remaining on the drum surface and to uniformly charge the cylindrical surface of the drum 5. Likewise, the second photosensitive drum 7 is surrounded by an optical unit 18 serving to produce an electrostatic latent image on the cylindrical surface of the drum 7, a developing unit 19 serving to make the latent image visible by applying toner, and a cleaning/charging unit 20 serving to remove unwanted toner remaining on the drum surface and to uniformly charge the cylindrical surface of the drum 7.

Figure 2:
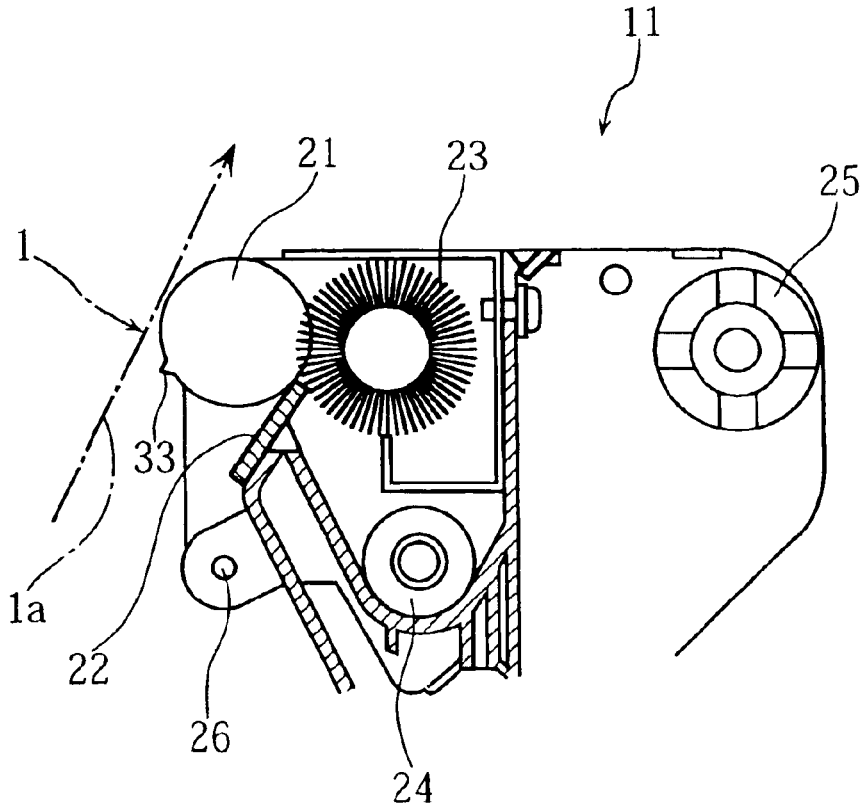
FIG. 2 is a side view showing, in section, the components of a guide roller unit used for the printer of the present invention.

FIG. 2 shows the components of the first guide roller unit 11. Specifically, the unit 11 includes a guide roller 21, a rubber cleaning blade 22, a fur brush 23, a toner discharge screw 24 and a coupling 25. The unit 11 is pivotable about a supporting shaft 26. The guide roller 21 and the toner discharge screw 24 are connected to an electric motor (not shown) via an appropriate power transmitter (which may consist of gears, chains, etc.) and the coupling 25. Thus, when the motor is turned on, the roller 21 and the screw 24 are rotated. The diameter of the roller 21 may be about 20 mm, and the rotational speed of the roller 21 may be about 580 rpm. The circumferential speed of the roller 21 is controlled to be the same as the transfer speed of the recording paper 1. The rotatable roller 21 is held in contact with the first recording side 1*a* of the paper 1 for guiding the paper 1. At this stage, the toner image transferred onto the first recording side 1*a* is unfixed, whereby some toner will cling to the contact surface of the roller 21. This unwanted toner is removed to some extent by the fur brush 23, and then the remaining toner is scraped by the cleaning blade 22. The brushed or scraped toner is carried into a toner box (not shown) by the toner discharge screw 24. As readily understood, the second guide roller unit 12 has the same structure as the first guide roller unit 11.

Figure 3:
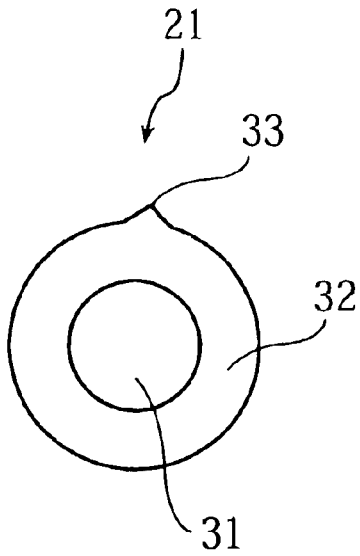
FIG. 3 shows the detailed structure of a guide roller used for the guide roller unit of FIG. 2.

FIG. 3 is a side view showing the guide roller 21. As illustrated, the roller 21 consists of a cylindrical core 31 (made of stainless steel or any other strong and rustproof material) and a contact layer 32 surrounding the core 31. The contact layer 32 may be made of fluoroplastic or any other material to which unfixed toner cannot easily adhere. The contact layer 32 is provided with a projection 33 extending over the entire width of the layer 32. As illustrated in the figure, the cross section of the projection 33 is triangular. The height of the projection 33 may be about 20 $\mu$m, which corresponds to the total length of two toner particles put together.

The projection 33 of the contact layer 32 may be produced in the following manner. First, a thermally shrinkable tube, made of e.g. fluoroplastic, is put around the core 31. The inner diameter of the tube may be greater than the (outer) diameter of the core 31 by 10%. Then, the tube is heated to shrink to be fitted around the core 31. Since the tube is initially larger than the core 31, the shrunk material is partially raised than the remaining portion, thereby providing the projection 33. Instead of using such a shrinkable tube, a fluoroplastic material may be applied over the cylindrical surface of the core 31 to produce the contact layer 32 and the projection 33.

The guide roller of the second guide roller unit 12 is identical to the guide roller 21 described above.

Figure 4:
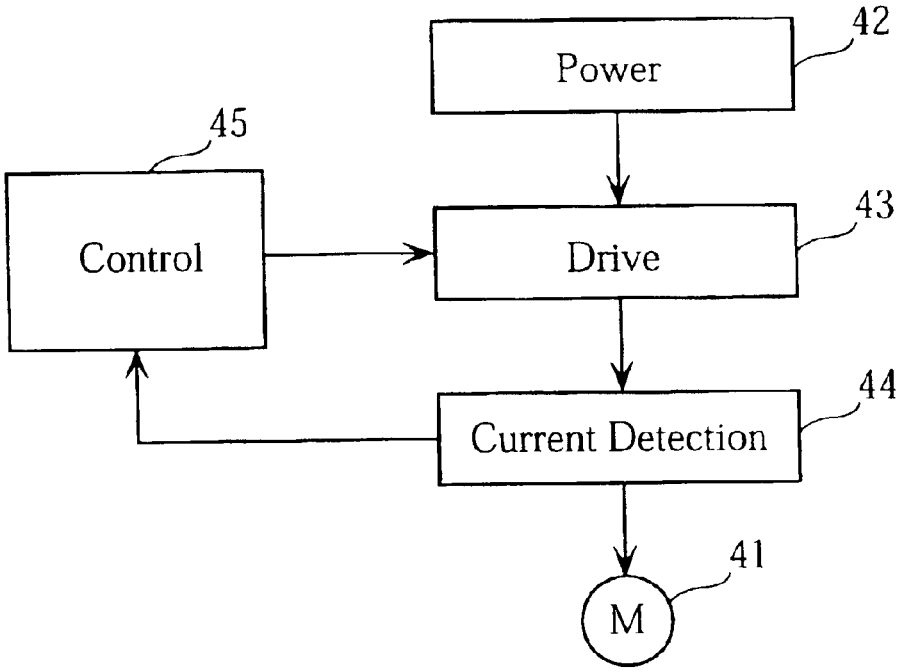
FIG. 4 is a block diagram illustrating a driving system for the guide roller shown in FIGS. 2 and 3.

FIG. 4 is a block diagram showing a driving system for the guide roller 21. Specifically, the guide roller 21 is rotated by a motor 41 to which power is supplied from a power circuit 42 via a driving circuit 43. Between the driving circuit 43 and the motor 41, a current detecting circuit 44 is provided for detecting the driving current supplied to the motor 41. The driving circuit 43 is controlled by a control circuit 45 including a CPU (central processing unit).

The detection data obtained by the detecting circuit 44 is sent to the control circuit 45. Based on this data, the control circuit 45 calculates the variation of the driving current supplied to the motor 41. Generally the driving current will vary depending on whether or not the projection 33 of the rotating guide roller 21 is in contact with the cleaning blade 22. More specifically, when the projection 33 of the rotating guide roller 21 is being held in contact with the cleaning blade 22, a greater load is exerted on the motor 41, and accordingly the driving current supplied to the motor 41 will increase. When the projection 33 is off the blade 22, on the other hand, the driving current supplied to the motor 41 will decrease. Based on such driving current variation, the control circuit 45 checks the wear of the contact layer 32 and projection 33. The details will be described below.

Figure 5:
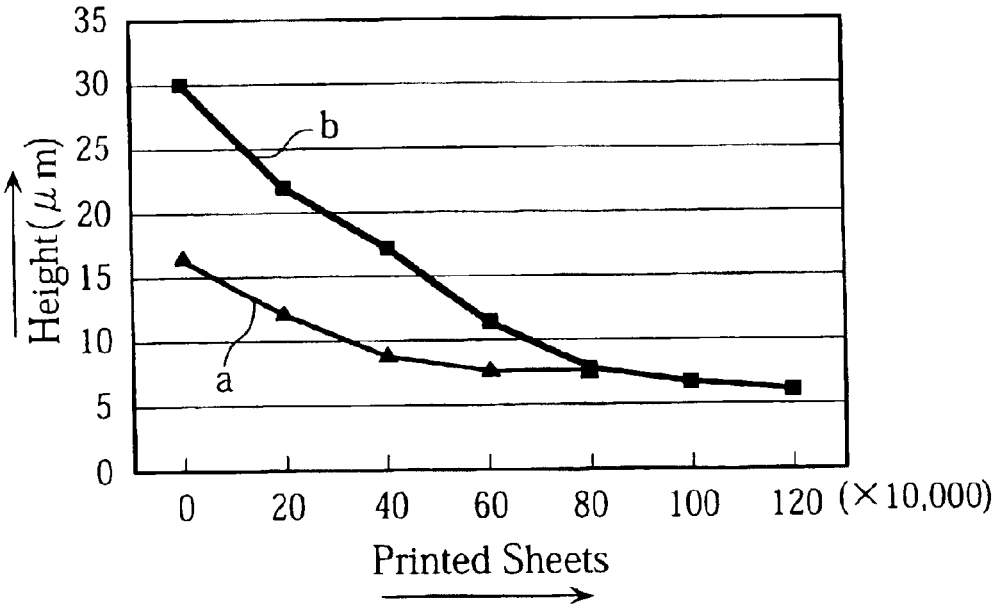
FIG. 5 is a graph showing how the guide roller is worn thin in operation.

Referring to FIG. 5, the graph shows that the contact layer 32 (indicated by a broken line a) is worn thin more gently than the projection 33 (indicated by a broken line b), as the number of printed recording sheets increases. It should be noted that the two broken lines a, b meet when approximately 800,000 recording sheets have been subjected to printing operation, and they extend together thereafter. The merging of the two broken lines shows that the contact layer 32 and the projection 33 become equal in height, which means that the projection 33 has disappeared. With no projection on the contact layer 32, the guide roller 21 cannot serve the expected function (to be described below) and should be replaced.

Figure 6:
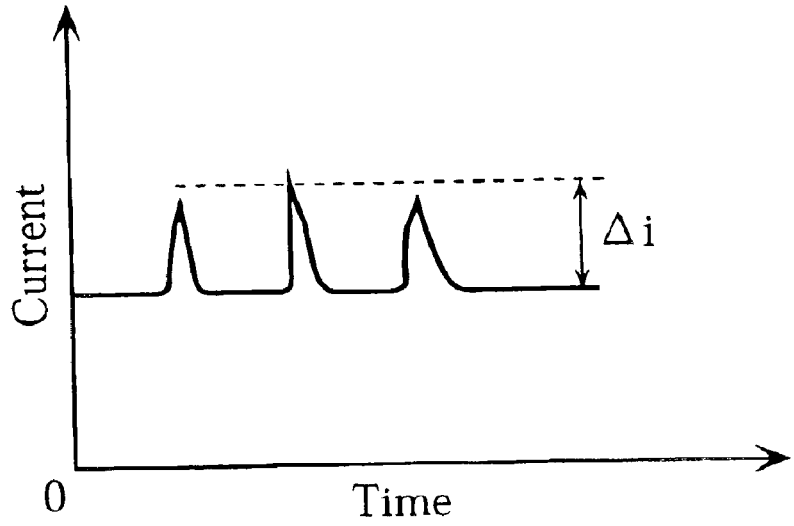
FIG. 6 is a graph showing the variation in a driving current supplied to actuate the guide roller.

The disappearance of the projection 33 is detected by checking the variation of the driving current supplied to the motor 41. To elaborate on this, reference is now made to the graph of FIG. 6 which shows the variation of the driving current to be supplied to the motor 41. The graph shows three pulses in the otherwise level current. These pulses are generated each time the projection 33 of the rotating roller 21 bumps into the cleaning blade 22. The height i of the pulse becomes smaller as the projection 33 is worn thin. Based on the driving current detection, the control circuit 45 calculates the height i of the pulse. When the height i is smaller than a predetermined threshold, the control circuit 45 determines that the projection 33 has worn away so that it is no longer useful.

The operation of the printer will now be described below.

As the paper 1 is advanced along the paper transfer path by the pinch roller unit 2 and the tractor 3, the toner image formed on the first photosensitive drum 5 is transferred onto the first recoding side 1*a* of the paper by the first transfer unit 4. Further, downstream from the first transfer unit 4, the second transfer unit 6 causes the toner image formed on the second photosensitive drum 7 to be transferred onto the second recording side 1*b* of the paper 1. During these image transfer operations, the first and the second guide roller units 11, 12 guide the paper 1 properly along the paper transfer path. The guide roller 21 of the first unit 11 comes into contact with the first recording side 1*a*, while the counterpart roller of the second unit 12 comes into contact with the second recording side 1*b*.

In the above arrangement, the guide rollers of the first and the second units 11, 12 roll over the unfixed toner images transferred onto the respective recoding sides 1*a*, 1*b* of the paper 1. As a result, some toner will adhere to the contact surfaces of the rollers. Part of the toner on the roller is removed by the fur brush 23 (FIG. 2), and the remaining toner is scraped off by the cleaning blade 22 (precisely, a negligible amount of toner may still remain) The brushed or scraped toner is carried to the toner box by the action of the toner discharge screw 24.

In the printer of the present invention, likewise of the prior art printer, paper dust (and other kinds of dust as well) may adhere to the contact surface of the rotating guide roller 21, and can get stuck between the roller 21 and the cleaning blade 22. In the prior art printer, the stuck paper dust may prevent the cleaning blade from coming into proper contact with the guide roller, whereby the toner adhering to the guide roller may fail to be scraped off. This is disadvantageous to attaining high-quality printing. According to the present embodiment, the guide roller 21 is formed with the projection 33 (FIG. 3), which comes into contact with the cleaning blade 22 each time the roller 21 makes a complete turn. Advantageously, upon contact with the cleaning blade 22, the projection 33 causes vibrations in the blade 22, and thus the paper dust between the roller 21 and the blade 22 will be released. In this state, the cleaning blade 22 can scrape all the remaining toner off the guide roller 21, and high-printing quality can be achieved.

The current detecting circuit 44 detects the driving current supplied to the motor 41 for operating the guide roller 21. The obtained detection data is sent to the control circuit 45, in which the variation i of the driving current (see FIG. 6) is compared with the prescribed threshold. When the variation i is no greater than the threshold, the control circuit 45 determines that the guide roller 21 has been unacceptably worn. In this instance, the control circuit 45 informs the user of the need to replace the guide roller unit with a new one. This information may be given visually (with the use of a liquid crystal display, an LED indication lamp, etc.) or by sound.

According to the present invention, the control circuit 45 may or may not check the wear condition of the roller 21 constantly in operation. The circuit 45 may check it only when the printer is turned on.

Figure 7:
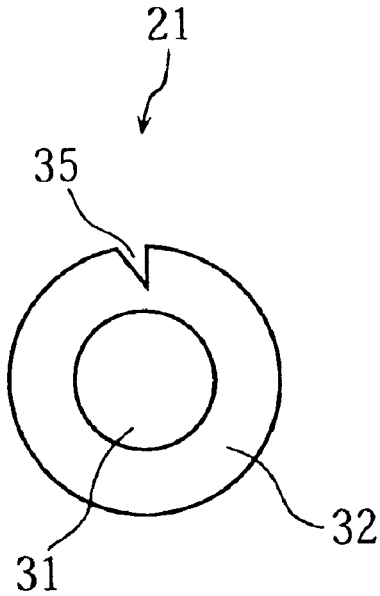
FIG. 7 is a side view showing a possible modification of the guide roller used for the guide roller unit of FIG. 2.

Instead of the projection 33, the contact layer 32 of the roller 21 may be formed with a wedge-like groove 35, as shown in FIG. 7. The depth of the groove 35 may be about 20 $\mu$m.

The contact layer 32 may be formed with more than one projection 33 and/or more than one groove 35 spaced about the rotational axis of the roller 21.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A guide roller unit comprising:

a guide roller for guiding printing paper, the guide roller being provided with a contact surface wherein substantially the entire circumference of the contact surface comes into contact with a printed paper having an unfused toner image thereon; and a cleaning blade that comes into contact with the contact surface of the guide roller for removing toner adhered to the contact surface;

wherein the contact surface of the guide roller is provided with a blade contact portion for vibrating the cleaning blade.

2. The unit according to claim 1, wherein the blade contact portion comprises one of a projection and a groove.

3. The unit according to claim 2, wherein the projection has a height of about 20 $\mu$m, the groove having a depth of about 20 $\mu$m.

4. The unit according to claim 1, wherein the guide roller includes a core made of a stainless metal and a fluoroplastic layer surrounding the core.

5. The unit according to claim 1, wherein the blade contact portion extends over an entire width of the contact surface of the guide roller.

6. A printer comprising:

a photosensitive member upon which a toner image is produced;

a transfer unit for transferring the toner image onto a first surface of the printing paper;

a fixing unit for fixing the transferred toner image on the first surface of the printing paper, the fixing unit being located downstream from the transfer unit along a paper transfer path for the printing paper; and a guide roller unit that includes a guide roller provided with a contact surface, wherein substantially the entire circumference of the contact surface comes into contact with the first surface of the printing paper having the transferred toner image thereon, the guide roller unit also including a cleaning blade coming into contact with the guide roller for removing toner adhering to the contact surface of the guide roller, the guide roller unit being located between the transfer unit and the fixing unit;

wherein the contact surface of the guide roller is provided with at least one of a projection and a groove that extend along a rotational axis of the guide roller for vibrating the cleaning blade by contacting therewith.

7. The printer according to claim 6, wherein the guide roller includes a core made of a stainless metal and a fluoroplastic layer surrounding the core.

8. The printer according to claim 6, wherein the projection and the groove extend over an entire width of the guide roller.

9. The printer according to claim 6, wherein the projection has a height of about 20 $\mu$m, the groove having a depth of about 20 $\mu$m.

10. The printer according to claim 6, further comprising a detecting unit for checking whether or not the guide roller is unacceptably worn thin.

11. The printer according to claim 10, wherein the detecting unit monitors variation in driving current supplied to a motor to actuate the guide roller.

12. The printer according to claim 6, further comprising:

an additional photosensitive member;

an additional transfer unit for causing a toner image produced on the additional photosensitive member to be transferred onto a second surface of the printing paper opposite to the first surface of the printing paper;

a first fixing unit for fixing the toner image transferred onto the first surface, the first fixing unit being located downstream from the additional transfer unit along the paper transfer path; and a second fixing unit for fixing the toner image transferred onto the second surface, the second fixing unit being located downstream from the additional transfer unit along the paper transfer path.

13. The printer according to claim 12, further comprising an additional guide roller unit located between the additional transfer unit and the second fixing unit, wherein the additional guide roller unit comprises a second-surface guide roller coming into contact with the second surface of the printing paper and also comprises a cleaning blade coming into contact with the second-surface guide roller for removing toner adhering to the second-surface guide roller, and wherein the second-surface guide roller is provided with one of a projection and a groove that come into contact with the cleaning blade.

* * * * *